US005094292A

United States Patent [19]

Buckshaw

[11] Patent Number: 5,094,292

[45] Date of Patent: Mar. 10, 1992

[54] TUBE SHIELD

[76] Inventor: Dennis J. Buckshaw, 42240 Crestview, Northville, Mich. 48167

[21] Appl. No.: 712,397

[22] Filed: Jun. 10, 1991

[51] Int. Cl.[5] ..... F28F 19/00

[52] U.S. Cl. ..... 165/134.1; 165/110; 122/DIG. 13

[58] Field of Search ..... 165/110, 134.1, 162; 122/DIG. 13

[56] References Cited

U.S. PATENT DOCUMENTS

| | | | |
|---|---|---|---|
| 2,646,818 | 7/1953 | Bimpson | 165/134.1 X |
| 3,318,374 | 5/1967 | Block | 165/134 |
| 3,568,763 | 3/1971 | Stoker et al. | 165/110 |
| 3,850,146 | 11/1974 | Graham et al. | 122/6 A |
| 3,999,600 | 12/1976 | Bell | 165/78 |
| 4,168,737 | 9/1979 | Yoshimitsu | 165/76 |
| 4,619,314 | 10/1986 | Shimoda | 165/104.16 |
| 4,667,733 | 5/1987 | Bessouat et al. | 165/134.1 |
| 4,776,790 | 10/1988 | Woodruff | 432/233 |
| 4,809,645 | 3/1989 | Fournier et al. | 122/6 A |
| 4,832,795 | 5/1989 | Lorenz et al. | 202/228 |
| 4,919,199 | 4/1990 | Hahn | 165/162 |

OTHER PUBLICATIONS

Helmick Corporation Brochure, "Eliminate Boiler and Condenser Tube Failure With Helmick Tube Shields", (2 pp.).

*Primary Examiner*—Allen J. Flanigan
*Attorney, Agent, or Firm*—Krass & Young

[57] ABSTRACT

A tube shield and a method of providing shielding for tubes. The tube shield is provided in a cane or J-configuration, including an upper hook portion and a sheet portion, and a U or drape configuration, including an upper hook portion and a pair of spaced sheet portions extending downwardly from the hook portion in a parallel spaced relation. In both shields, spacer means are provided in the form of embossed protuberances of generally hemispherical configuration extending outwardly from the general plane of the sheet portions at spaced locations on the sheet portions. In the assembled relation of the shields in a tube installation, cane shields are hooked over the outboard rows of tubes and drape shields are hooked over the inboard rows of tube with the protuberances on the sheet portions of the tubes maintaining the sheet portions of the adjacent shields in positive spaced relation.

13 Claims, 2 Drawing Sheets

TUBE SHIELD

FIELD OF THE INVENTION

This invention relates to tube shields and more particularly to shields for use in protecting the tubes of heat exchangers, such as boilers and condensers, from hostile elements.

BACKGROUND OF THE INVENTION

Tubes are in common use in various heat exchanger apparatuses such, for example, as boilers and condensers. The tubes employed in a boiler are commonly exposed to hostile elements such as fly ash. These hostile elements can have the effect of abrading and corroding the tubes with the result that the tubes experience early failure resulting in major maintenance and significant boiler down-time costs. Many devices have been devised to protect the tubes from the hostile elements. In one such protective device, metal sheets are hung between rows of vertical tubes and vertically arranged bars are welded to the faces of the sheets so as to maintain adjacent sheets in proper spaced relation. Whereas this arrangement has been generally effective in shielding the tubes from the hostile elements, the tube shields employing such spacer bars suffer from several disadvantages. Specifically, the bars add significantly to the cost of the tube shields both in terms of added material and in terms of added labor to weld the bars to the sheets; the bars add significantly to the weight of the shields; the welds holding the bars to the sheets ultimately fail with the result that the bars fall off and drop into the economizer bin of the boiler with consequent damage to the boiler and consequent boiler down-time to remove the bars; the shields, after the bars have fallen off, will themselves work loose from the tubes and fall downwardly into the economizer bin with consequent damage; and the bars tend to rigidify the shields to the extent that the shields are substantially inflexible and cannot be flexed or bent to facilitate installation between closely spaced tubes.

SUMMARY OF THE INVENTION

The present invention is directed to the provision of an improved tube shield for use in connection with heat exchanger tubes.

More specifically, the present invention is directed to the provision of a tube shield which is inexpensive and durable and which may be readily flexed or bent to facilitate installation between closely spaced tubes.

The tube shield of the invention is of the type including an upper hook portion adapted to be hooked over a tube and a main body planar sheet portion adapted to hang downwardly from the hook portion between vertical rows of tubes to protect the tubes from hostile elements. The invention tub shield is characterized in that the shield is formed of a single unitary piece of sheet metal with selected areas of the sheet portion deformed out of the primary plane of the sheet portion to define spacer means to maintain the desired spacing between the sheet portions of adjacent shields. With this arrangement, the shields may be inexpensively formed, there are no bars or other adjuncts to ultimately fall off the shield with consequent damage and down time, and the shields retain a flexibility sufficient to allow them to be inserted between the tubes even in very tight quarters.

According to a further feature of the invention, the sheet portion is embossed at the selected deformed areas to form protuberances extending outwardly from the primary plane of the sheet portion to define the spacer means. The protuberances provide a ready and efficient means of providing the necessary spacing between the sheets without detracting from the flexibility of the sheet.

According to a further feature of the invention, the protuberances have a generally hemispherical configuration. This configuration is readily formed and readily provides the desired spacer function.

According to a further feature of the invention, the protuberances are provided in a pattern that is asymmetrical with respect to the vertical center line of the sheet portion.

According to a further feature of the invention, the sheet portion comprises a first sheet portion, the shield further includes a second sheet portion parallel to but spaced from the first sheet portion, the hook portion interconnects the upper ends of the first and second sheet portions to form a shield of inverted U-configuration, and selected areas on each sheet portion are deformed out of the primary plane of the respective sheet portion to define the spacer means.

According to a further feature of the invention, the embossed portions on the first sheet portion are non-aligned with the embossed portions on the second sheet portion. Specifically, the embossed portions on the first sheet portion are on one side of the vertical center line of the shield and the embossed portions on the second portion are on the other side of the vertical center line of the shield.

The invention also provides a methodology for shielding vertical rows of tubes from hostile elements. According to the invention methodology, a plurality of sheets of sheet metal are formed with each sheet selectively deformed to define embossed portions raised out of the primary plane of the sheet and a pair of sheets is hung between each row of tubes with the sheets separated by a distance corresponding to the height of the embossed portions so that the embossed portions maintain the sheets in spaced relation.

According to a feature of the invention methodology, the embossed portions comprise protuberances and the method comprises the steps of providing protuberances in a first area of one of the pairs of sheets extending toward and into spacing engagement with a first confronting area on the other of the pairs of sheets and further providing protuberances on another area of the other sheet extending toward and into spacing engagement with a second area on the one sheet.

DETAILED DESCRIPTION OF THE PREFERRED EMBODIMENT

Figure 1:
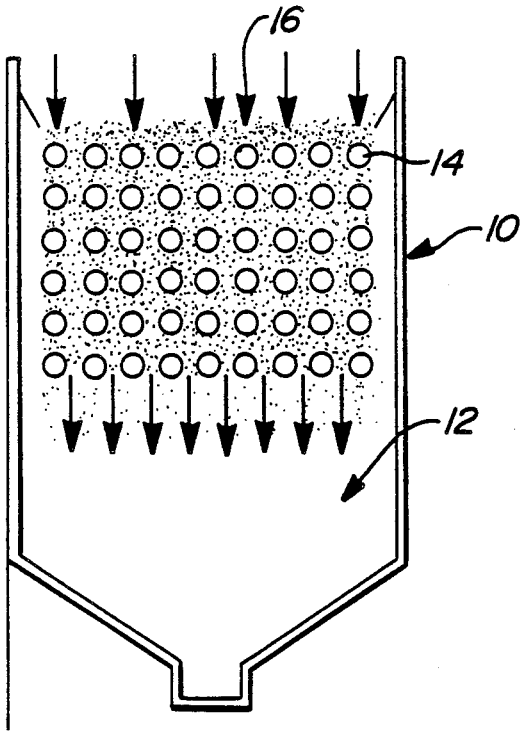
FIG. 1 is a view of a portion of a boiler employing vertical rows of tubes to perform a heat exchanger function within the boiler.

The apparatus illustrated in FIG. 1 may form a portion of a boiler or condenser and includes a housing 10 defining a chamber 12 within which vertical rows of tubes 14 are suitably positioned. The tubes are exposed to hostile elements as they perform their heat exchanger function such, for example, as fly ash 16 moving downwardly between the vertical rows of tubes. It will be understood that the fly ash results from the combustion of coal in an earlier phase of the overall boiler function. The tubes, if left exposed to the fly ash over an extended period of time, would quickly abrade and corrode. It is necessary therefore to protect the tubes from hostile elements such as fly ash 16.

Figure 5:
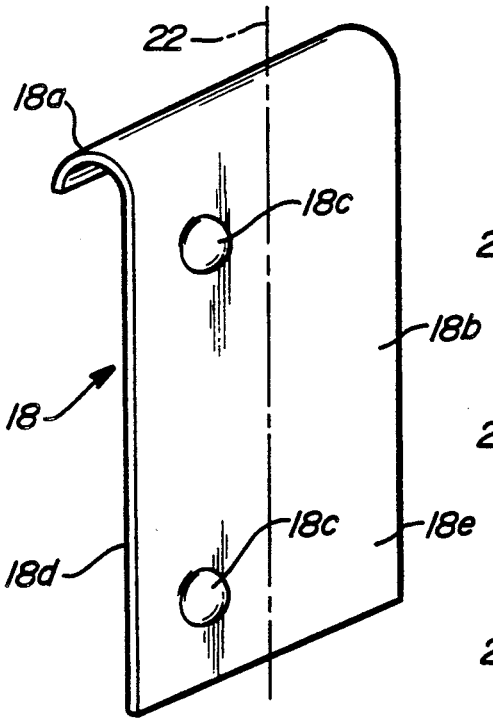
FIGS. 5 and 6 are perspective views of specific tube shields according to the invention.
Figure 6:
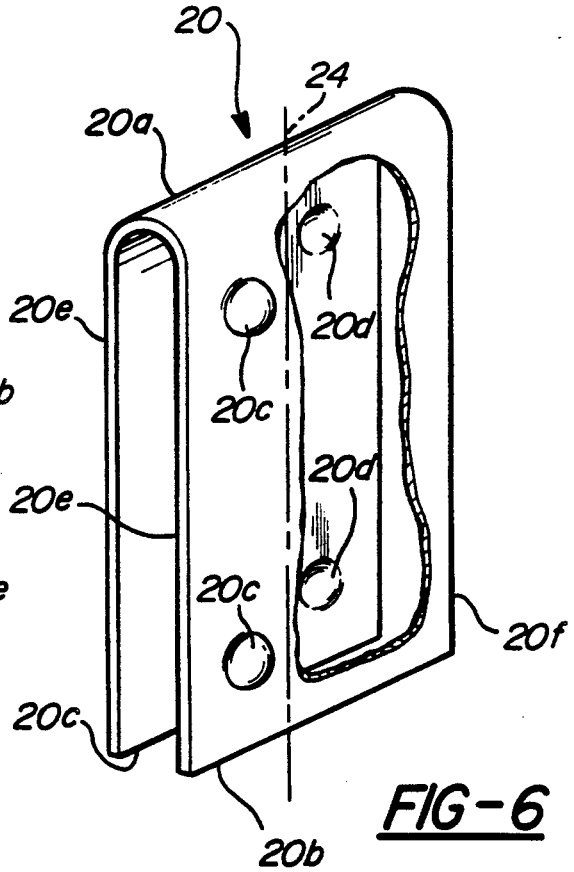

The tubes are shielded from the fly ash 16 according to the invention by the use of cane shields 18, of inverted J-configuration and best seen in FIG. 5, and drape shields 20, of inverted U-configuration and best seen in FIG. 6.

The invention shields, whether of the cane form as seen in FIG. 5 or the drape form as seen in FIG. 6, are preferably formed of a stainless steel material with the precise metallurgical content of the material being determined by the harshness of the environment from which the tubes are to be shielded. The stainless sheet stock utilized to form the shields may have a thickness of 16 gage with the other dimensions of the shields determined by the peculiarities of the particular installation.

The cane shield seen in FIG. 5 has an inverted J configuration and includes a hanger or hook portion 18*a* sized to be hooked over the upper tube 14 of a vertical row of tubes and a main body planar sheet portion 18*b* integrally joined at its upper end to the hook portion 18*a* and extending downwardly from the hook portion. Main body sheet portion 18*b* is suitably embossed to form a plurality of protrusions 18*c*. Protuberances 18*c* preferably have a generally hemispherical configuration and may in a typical installation have an inside depth of 0.875 inches and a nominal outer diameter of 1.5 inches. Protuberances 18*c* are asymmetrical with respect to the vertical center line 22 of the shield and are preferably formed in a vertical row positioned between the vertical center line of the shield and the front vertical side edge 18*d* of the shield. The radius of the hook or hanger portion 18*a* of the shield will depend upon the radius of the tubes 14 being protected; the vertical height of the shield may range from 16 to 63 inches; and the width of the shield as measured between side edges 18*d* and 18*e* may range from 18 to 30 inches.

The drape shield seen in FIG. 6 has an inverted U configuration and includes a hanger or hook portion 20*a*, a first sheet portion 20*b* suitably joined at its upper end to hanger portion 20*a*, and a second sheet portion 20*c* integrally joined at its upper end to hanger portion 20*a* and positioned in parallel spaced relation to sheet portion 20*b*. Sheet portion 20*b* includes a pair of embossed protuberances 20*c* positioned on one side of the vertical center line 24 of the shield and sheet portion 20*c* includes a pair of embossed protuberances 20*d* positioned on the opposite side of the vertical center line 24. Protuberances 20*c* extend outward with respect to the outboard face of portion 20*b* and protuberances 20*d* extend outward with respect to the outboard face of portion 20*c* in a direction opposite to the direction of extension of protuberances 20*c*. Protuberances 20*c* preferably lie in a common vertical line so as to form a vertical row and protuberances 20*d* similarly lie on a common vertical line so as to form a vertical row. The radius of the hook or hanger portion 20*a* of the shield will vary depending upon the radius of the tubes 14 being protected; the vertical height of the shields may range from 16 to 24 inches; and the width of the shields as measured between side edges 20*e* and 20*f* may range from 18 to 30 inches.

Figure 4:
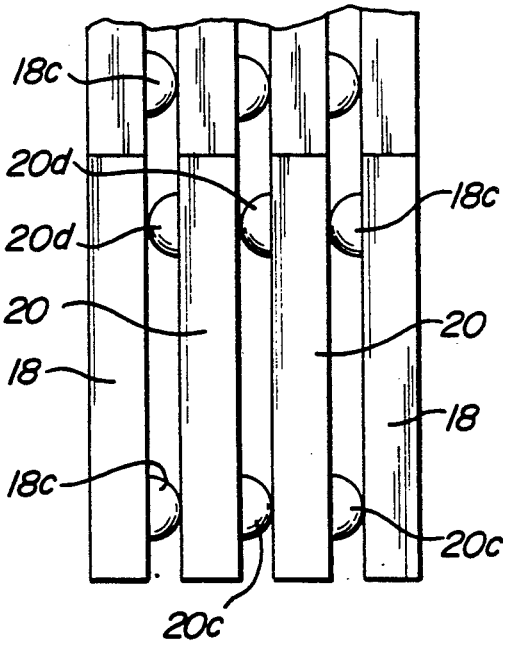
FIG. 4 is a fragmentary plan view of the tube installation seen in FIG. 2.
Figure 2:
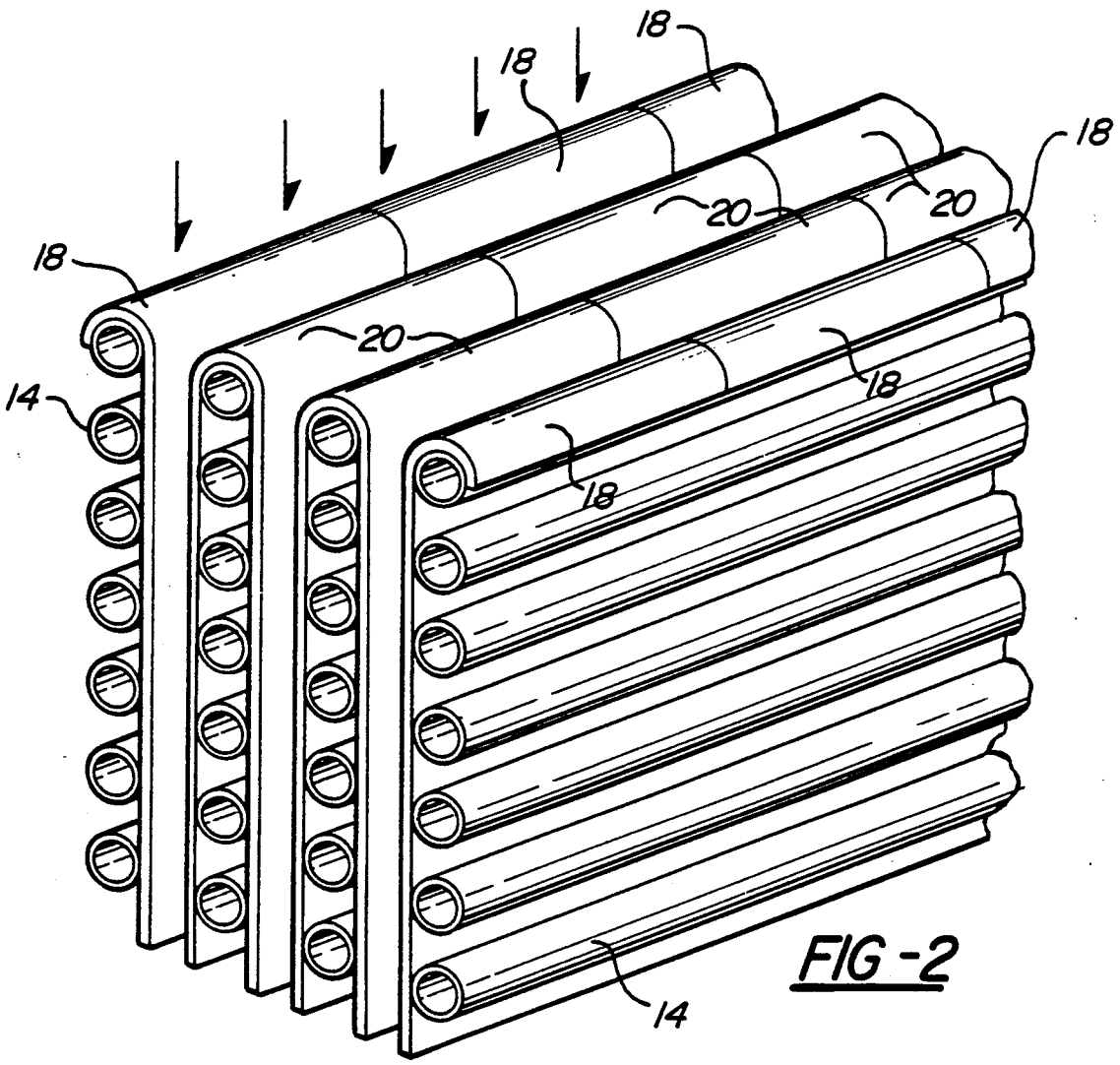
FIG. 2 is a fragmentary perspective view showing the invention tube shields installed in association with vertical rows of tubes.
Figure 3:
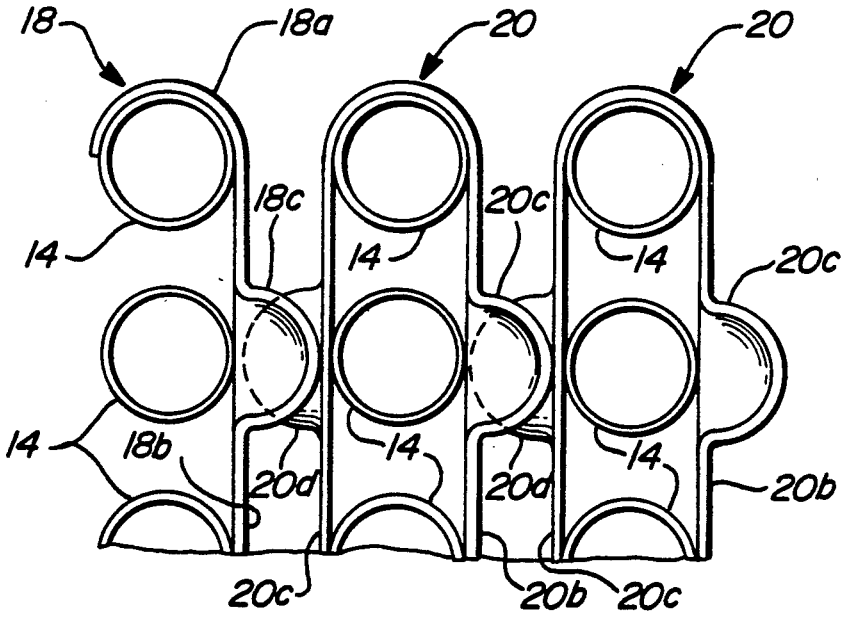
FIG. 3 is a fragmentary detail view of a portion of the tube installation seen in FIG. 2.

A typical installation involving a combination of cane shields 18 and drape shields 20 is seen in FIGS. 2, 3, and 4 in which a cane shield 18 is hooked over each outboard vertical row of tubes 14 and a drape shield 20 is hooked or draped over each inboard row of tubes 14. It should be understood that in the arrangement of FIGS. 2, 3 and 4, the outboard rows of tubes 14 require protection only along their inboard faces since the outboard faces of the tubes of the outboard rows are shielded from contaminants by the structure of the associated boiler or condenser.

As shown, with a cane shield hooked over each outboard row of tubes and a drape shield draped over each inboard row of tubes, the tubes are completely protected from contaminants such as fly ash and yet a clear essentially open space is maintained between the tubes so as not to impede the passage of the fly ash and so as not to impede or interfere with the heat exchange function taking place between the gases passing between the tubes and the fluid passing through the tubes. As seen, a plurality of cane shields 18 may be placed in end-to-end relation along the total length of the outboard tubes 14 and a plurality of drape shields may be placed in end-to-end relation along the total length of the inboard tubes 14. The cane shields 18 may be joined to successive cane shields 18, and the drape shields 20 may be joined to successive drape shields 20, by welding the adjacent confronting ends of the shields together, either in butt fashion or in overlapping fashion.

As seen, in the assembled relation of the cane shields and drape shields over the vertical rows of tubes, the protuberances 18*c* on the left hand cane shield 18 extend forwardly into spacing engagement with the sheet portion 20*c* of the adjacent drape shield 20 while the protuberances 20*d* formed in the sheet portion 20*c* of the drape shield 20 extend rearwardly into spacing engagement with the sheet portion 18*b* of the cane shield at a location on the cane shield spaced from the vertical line on which the cane shield protuberances 18*c* are formed. Similarly, with respect to adjacent drape shields 20, protuberances 20*c* on the sheet portion 20*b* of one drape shield 20 extend forwardly into spacing engagement with the sheet portion 20*c* of the adjacent cane shield while the protuberances 20*d* on the sheet portion 20*c* of the adjacent cane shield extend rearwardly into spacing engagement with the sheet portion 20*b* of the first cane shield at a location spaced from the vertical line on which the protuberances 20*c* are formed on the first cane shield. Similarly, with reference to the right-hand cane shield 18 and the drape shield 20 disposed of the right-hand cane shield, protuberances 20*c* on the sheet portion 20*b* of the drape shield extend forwardly into spacing engagement with the sheet portion 18*b* of the cane shield and the protuberances 18*c* on the cane shield extend rearwardly into spacing engagement with the sheet portion 20*b* of the drape shield at a location thereon spaced from the line on which the protuberances 20*c* are formed. Each adjacent pair of shields is therefore spaced from each other by a row of protuberances on a sheet portion of one shield engaging a first area on the adjacent sheet portion of the next shield and with a row of protuberances on the sheet portion of the next shield engaging the sheet portion of the first shield at a location spaced from the protuberances on the first shield. Further, it will be seen that the same cane shields may be used for both left and right installations with the shield simply rotated through 180 degrees to allow it to function as the left-hand shield as seen in the FIGURES and as the right-hand shield as seen in the FIGURES.

The invention tube sheet arrangement will be seen to provide many important advantages as compared to prior art tube shields. Specifically, since the shields are formed of a unitary piece of sheet metal there are no add-on members which can fall off to obstruct the operation of the associated boiler or condenser; since there are no add-on spacer members to fall off, the shields are always maintained in a positive spaced relation with respect to each other and remain positively engaged with the associated tubes; since no add-on members are required, the material cost of the add-on members, as well as the labor required to weld the add-on members to the shields, is eliminated with a consequent significant cost saving; since there are no add-on members and the spacer means are formed as integral portions of the shield, the shield has a relatively light weight as compared to prior art devices; and since the protuberances provided in the sheet portion of the shield are selectively spaced with respect to the overall area of the shield and occupy only a small portion of the total area of the shield, the flexibility of the shield is not impaired so that the shield may be flexed as necessary to accomplish the installation of the shield even between closely spaced tubes.

Whereas a preferred embodiment of the invention has been illustrated and described in detail, it will be apparent that various changes may be made in the disclosed embodiment without departing from the scope or spirit of the invention.

I claim:

1. A tube shield of the type including an upper hook portion adapted to be hooked over a tube and a main body planar sheet portion adapted to hang downwardly from the hook portion between vertical rows of tubes to protect the tubes from hostile elements, characterized in that the sheet is formed of a single unitary piece of sheet metal with selected areas of the sheet portion deformed out of the primary plane of the sheet portion to define spacer means to maintain a desired spacing between the sheet portions of adjacent shields.

2. A tube shield according to claim 1 wherein said sheet portion is embossed at said selected deformed areas to form protuberances extending outwardly from the primary plane of the sheet portion to define the spacer means.

3. A tube shield according to claim 2 wherein the protuberances have a generally hemispherical configuration.

4. A tube shield according to claim 2 wherein said protuberances are provided in a pattern that is asymmetrical with respect to the vertical center line of the sheet portion.

5. A tube shield according to claim 4 wherein said protuberances are provided only at one side of said center line.

6. A tube shield according to claim 5 wherein said protuberances are provided in a vertical row positioned between the vertical center line and a vertical side edge of the sheet portion.

7. A tube shield according to claim 1 wherein said sheet portion comprises a first sheet portion, said shield further includes a second sheet portion positioned parallel to but spaced from said first sheet portion, said hook portion interconnects the upper ends of said first and second sheet portions to form a shield of inverted U-configuration, and selected areas of each sheet portion are deformed out of the primary plane of the respective sheet portion to define spacer means.

8. A tube shield according to claim 7 wherein said selected areas of said sheet portions comprise embossed protuberances.

9. A tube shield according to claim 8 wherein the embossed portions of said first sheet portion are non-aligned with respect to the embossed portions on said second sheet portion.

10. A tube shield according to claim 9 wherein the embossed portions on said first sheet portion are on one side of the vertical center line of said shield and the embossed protuberances on said second sheet portion are on the other side of the vertical center line of said shield.

11. A tube shield according to claim 10 wherein the embossed protuberances on each sheet portion are provided in a vertical row positioned between the vertical center line of the shield and a vertical side edge of the respective sheet portion.

12. A method of shielding vertical rows of tubes from hostile elements comprising:

forming a plurality of sheets of sheet metal with each sheet selectively deformed to define embossed portions raised out of the primary plane of the sheet; and hanging a pair of sheets between each row of tubes with the sheets separated by a distance corresponding to the height of the embossed portions so that said embossed portions maintain the sheets in spaced relation.

13. A method according to claim 12 wherein said embossed portions comprise protuberances, and said method includes the steps of providing protuberances in a first area of one of said pair of sheets extending toward and into spacing engagement with a first confronting area on the other of said pair of sheets and further providing protuberances on another area of said other sheet extending toward and into spacing engagement with a second area on said one sheet.

* * * * *